US009702130B2

(12) United States Patent
Fukuya et al.

(10) Patent No.: US 9,702,130 B2
(45) Date of Patent: Jul. 11, 2017

(54) TOILET FLUSH TANK

(71) Applicant: LIXIL Corporation, Koto-ku, Tokyo (JP)

(72) Inventors: Kouji Fukuya, Tokyo (JP); Naokazu Onishi, Tokyo (JP); Ken Higuchi, Tokyo (JP); Yuji Saito, Tokyo (JP); Kojiro Watari, Tokyo (JP)

(73) Assignee: LIXIL CORPORATION, Koto-Ku, Tokyo (JP)

( * ) Notice: Subject to any disclaimer, the term of this patent is extended or adjusted under 35 U.S.C. 154(b) by 208 days.

(21) Appl. No.: 14/621,861

(22) Filed: Feb. 13, 2015

(65) Prior Publication Data

US 2015/0159356 A1 Jun. 11, 2015

Related U.S. Application Data

(63) Continuation of application No. PCT/JP2013/067308, filed on Jun. 25, 2013.

(30) Foreign Application Priority Data

Aug. 17, 2012 (JP) ..... 2012-180842

(51) Int. Cl.
*E03D 1/24* (2006.01)
*E03D 5/01* (2006.01)
(Continued)

(52) U.S. Cl.
CPC ..... *E03D 1/24* (2013.01); *E03D 1/28* (2013.01); *E03D 5/01* (2013.01); *E03D 11/16* (2013.01)

(58) Field of Classification Search
CPC ..... D03D 1/24; D03D 1/26; D03D 1/28
(Continued)

(56) References Cited

U.S. PATENT DOCUMENTS 2,096,148 A * 10/1937 Ventrano ..... E03D 1/286 4/332
2,658,203 A * 11/1953 Aue ..... E03D 1/286 4/332

(Continued)

FOREIGN PATENT DOCUMENTS

CN 201116379 Y 9/2008
CN 101688389 A 3/2010

(Continued)

OTHER PUBLICATIONS

Japanese Notification of Reason(s) for Refusal corresponding to Patent No. 2012-180842; Date of Issue: Aug. 4, 2015, with English translation.

(Continued)

*Primary Examiner* — Huyen Le
(74) *Attorney, Agent, or Firm* — Cantor Colburn LLP

(57) ABSTRACT

A toilet flush tank is provided that is capable of preventing an increase in the external dimensions of a toilet main body even when the toilet flush tank is placed below the upper surface of a toilet main body and is also capable of performing toilet cleaning in a stable manner. A toilet flush tank stores cleaning water to be provided to a toilet main body having a toilet bowl and a toilet drainage channel that communicates with the downstream side of the toilet bowl. This toilet flush tank is placed inside a space below the toilet bowl and provided with a recessed portion that conforms to the shape of the toilet drainage channel at the upper surface of the toilet flush tank.

6 Claims, 5 Drawing Sheets

(51) Int. Cl.
*E03D 1/28* (2006.01)
*E03D 11/16* (2006.01)

(58) Field of Classification Search
USPC ..... 4/319, 332, 29
See application file for complete search history.

(56) References Cited

U.S. PATENT DOCUMENTS 2,773,267 A * 12/1956 Kohlmeyer ..... E03D 1/286 4/331
4,217,668 A 8/1980 Sargent et al.

FOREIGN PATENT DOCUMENTS

JP 50045436 A 4/1975
JP 50058542 U 5/1975
JP S511611 Y2 1/1976
JP 11264173 A 9/1999
JP 2010138696 A 6/2010
TW 568122 U 12/2003

OTHER PUBLICATIONS

Chinese Notification of the First Office Action corresponding to U.S. Pat. No. 2013800435308; Date of Issue: Aug. 31, 2015, with English translation.
International Search Report corresponding to Application No. PCT/JP2013/067308; Date of Mailing: Aug. 13, 2013, with English translation.
Written Opinion of the International Searching Authority corresponding to Application No. JP/PCT2013/067308; Date of Mailing: Aug. 13, 2013, with English translation.
Taiwanese First Office Action corresponding to Application No. 102127751; Dispatch Date: May 11, 2016, with English translation.

* cited by examiner

TOILET FLUSH TANK

CROSS REFERENCE

This application is a continuation under 35 U.S.C. §120 of PCT/JP2013/067308, filed Jun. 25, 2013, which is incorporated herein by reference and which claimed priority to Japanese Application No. 2012-180842, filed Aug. 17, 2012, the entire content of which is also incorporated herein by reference.

TECHNICAL FIELD

The present invention relates to a toilet flush tank.

BACKGROUND ART

Patent document 1 discloses a conventional toilet flush tank. This toilet flush tank is provided below a front portion of a toilet bowl formed in a toilet main body. The toilet main body of a flush toilet provided with this toilet flush tank has a water discharge port at the lower part of the toilet bowl that is open toward a trap entrance. The toilet flush tank communicates with this discharge port. The flush toilet has a nozzle that is placed on an upstream side of the discharge port and that discharges tap water toward the discharge port. This nozzle is directly connected to a water pipe. Tap water discharged from the nozzle engulfs cleaning water stored inside the flush tank and flows into the trap entrance through the discharge port. As described, the flush toilet allows cleaning water having a flow rate (the volume of water that flows per unit time: the same applies hereinafter) that is higher than that of the tap water discharged from the nozzle to flow into the trap entrance. Therefore, the flush toilet is capable of efficiently pushing waste into a trap drainage channel.

[Patent document 1] Japanese Patent Application Publication No. 11-264173

DISCLOSURE OF THE INVENTION

Problem to be Solved by the Invention

However, the toilet flush tank according to Patent document 1 is designed to amplify the flow rate of cleaning water discharged from the discharge port by being mixed up with tap water discharged from the nozzle. Therefore, the storage capacity of the toilet flushtank is small. Enlargement of the storage capacity of the toilet flush tank if desired may cause the toilet main body to become larger toward the front thereof. Further, since the water supply pressure of tap water that is discharged from the nozzle changes depending on an installation site, an operating time, and the like, cleaning water having a stable flow rate cannot be supplied to the toilet main body. Therefore, the flush toilet may not be able to favorably perform toilet cleaning.

The present invention is made in consideration of the above-described problem in the related art, and an object thereof is to provide a toilet flush tank that is capable of preventing an increase in the external dimensions of a toilet main body even when the toilet flush tank is placed below a toilet bowl and is also capable of performing toilet cleaning in a stable manner.

Means to Solve the Problem

A toilet flush tank according to the present invention is a toilet flush tank that stores cleaning water to be provided to a toilet main body having a toilet bowl and a toilet drainage channel communicating with the downstream side of the toilet bowl, and that is placed inside a space below the toilet bowl and provided with a recessed portion that conforms to the shape of the toilet drainage channel at the upper surface of the toilet flush tank.

This toilet flush tank is provided with a recessed portion that conforms to the shape of a toilet drainage channel and is thus capable of storing cleaning water while effectively using a free space inside a space below a toilet bowl. Therefore, this toilet flush tank is capable of storing cleaning water in an amount that allows for one-time toilet cleaning. Further, since a flush toilet that is provided with this toilet flush tank is capable of performing toilet cleaning using only cleaning water stored in the flush tank, toilet cleaning can be performed using a constant amount of cleaning water every time without being affected by a change in the pressure of tap water.

Therefore, a toilet flush tank according to the present invention is capable of preventing an increase in the external dimensions of a toilet main body even when the toilet flush tank is placed below the upper surface of a toilet main body and is also capable of performing toilet cleaning in a stable manner.

BEST MODE FOR CARRYING OUT THE INVENTION

An explanation will be given regarding a preferred embodiment in the present invention.

The toilet flush tank may be provided with a water lifting device for discharging stored cleaning water from an upper part of the toilet bowl. In this case, the cleaning water stored in the toilet flush tank can be discharged from the upper part of the toilet bowl. Therefore, a flush toilet provided with this toilet flush tank is capable of allowing all the toilet cleaning water to be used for the cleaning of a toilet bowl and is thus capable of favorably cleaning the toilet bowl.

The toilet flush tank may be provided integrally with a drainage connecting pipe that connects a drainpipe drawn to a floor surface to the toilet drainage channel. In this case, a gap between the toilet flush tank and the drainage connecting pipe can be eliminated, and the storage capacity of the toilet flush tank can thus be increased.

The toilet flush tank may be provided with left and right water storage portions for storing cleaning water respectively on the left and right sides of the drainage connecting pipe that connects the drainpipe drawn to the floor surface to the toilet drainage channel. In this case, a free space in a space inside and below the outer peripheral edge of the upper surface of the toilet main body can be effectively used, and the storage capacity of the toilet flush tank can thus be increased.

Next, an explanation will be made with reference to figures regarding a first exemplary embodiment and a second exemplary embodiment in which a toilet flush tank according to the present invention is embodied.

<First Exemplary Embodiment>

Figure 1:
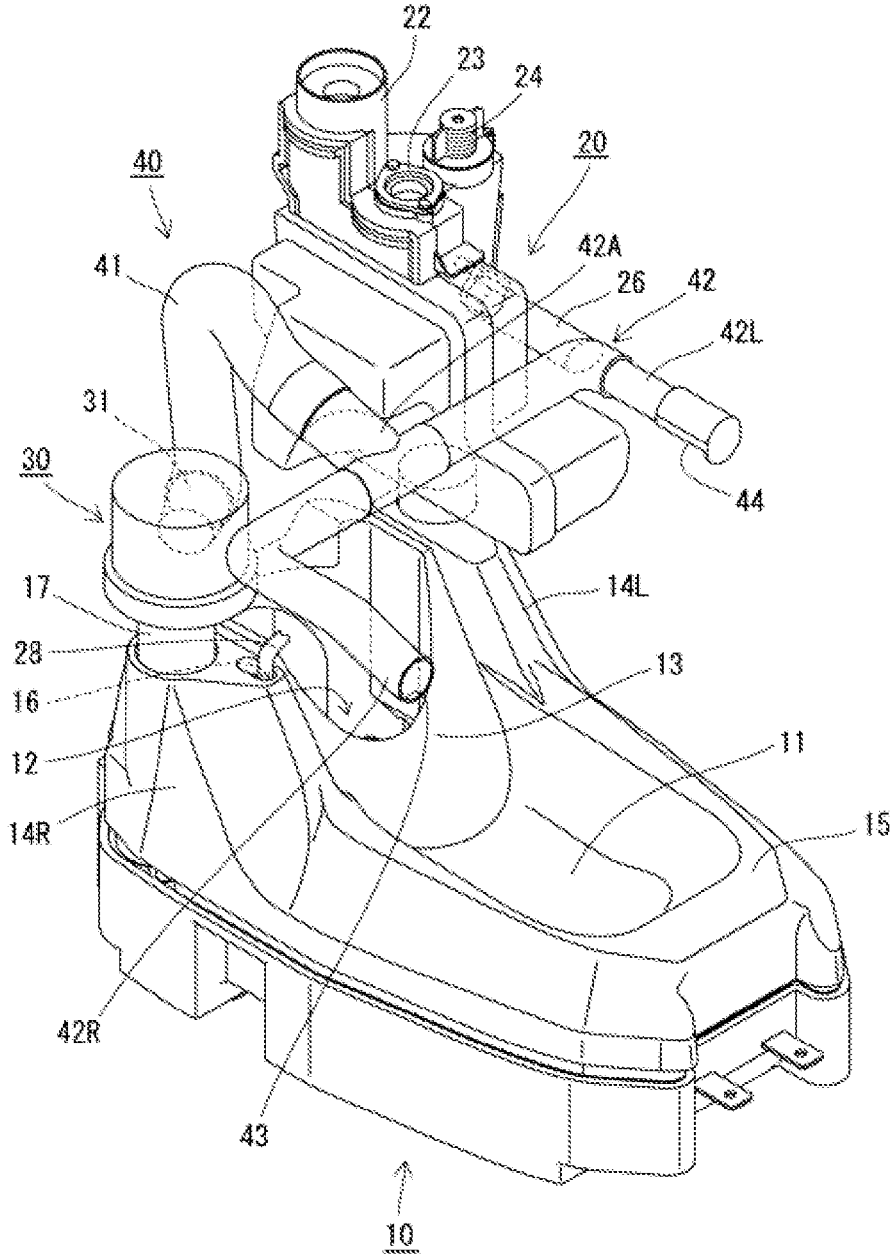
FIG. 1 is a perspective view of a toilet flush tank according to a first exemplary embodiment that is viewed from the right front direction.
Figure 2:
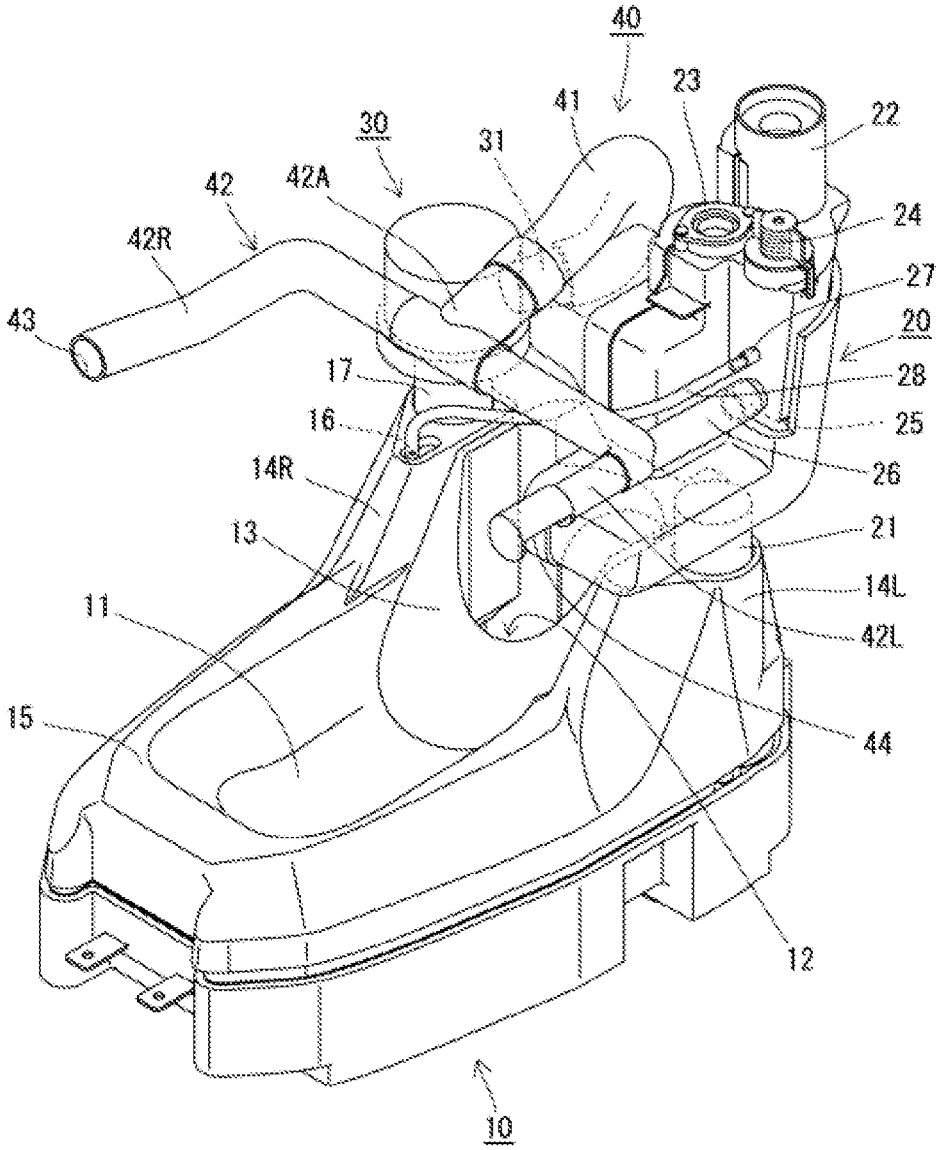
FIG. 2 is a perspective view of the toilet flush tank according to the first exemplary embodiment that is viewed from the left front direction.

As shown in FIGS. 1 and 2, a toilet flush tank according to a first exemplary embodiment has: a first tank 10; a second tank 20; a pump 30 of an electrically driven type, which is a water lifting device; and a water discharge pipe 40 having a first water discharge port 43 and a second water discharge port 44 communicating with a rim water passage 51A of a toilet main body 50 described later.

Figure 3:
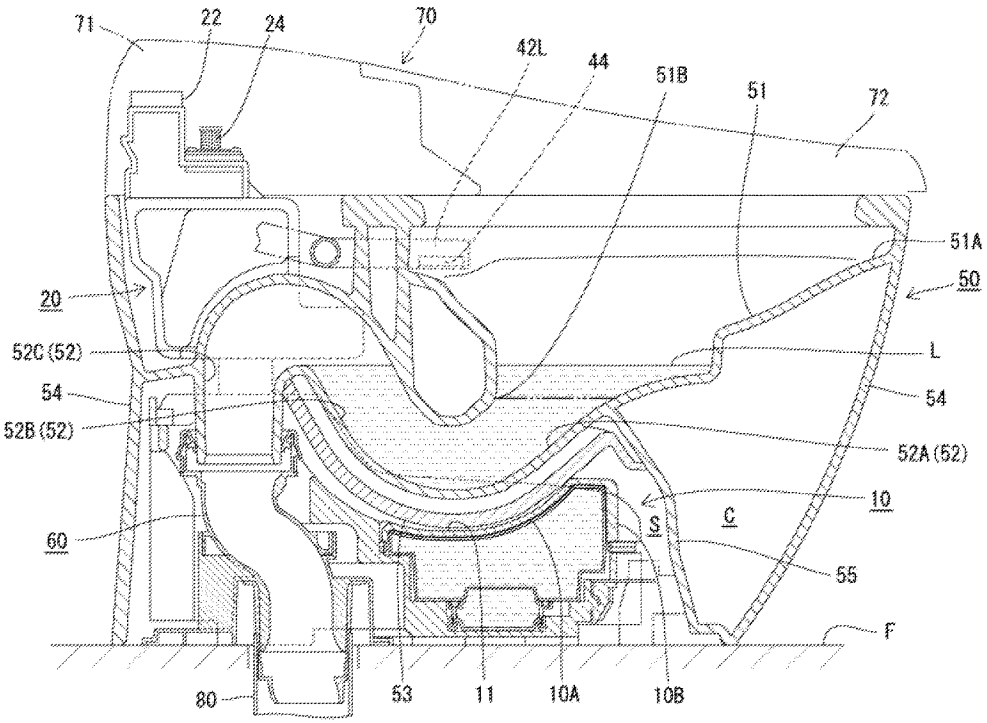
FIG. 3 is a cross-sectional view of a flush toilet provided with the toilet flush tank according to the first exemplary embodiment.

As shown in FIG. 3, the first tank 10 is formed in a double structure where an insulating material 10B is provided around a tank main body 10A that stores cleaning water inside thereof. Therefore, the first tank 10 is capable of preventing the generation of condensation that can be caused by the storage of cleaning water.

As shown in FIGS. 1 and 2, the first tank 10 is provided with a recessed portion 11 at the upper surface of a center portion in the crosswise direction thereof, which conforms to the shape of a toilet drainage channel 52 described later, when the toilet flush tank is placed inside the toilet main body 50 described later.

The first tank 10 is provided with a cutout portion 12 formed vertically in a penetrating manner behind (in the upper left direction in FIG. 1) the recessed portion 11 in order to vertically insert a drainage connecting pipe 60 described later when the toilet flush tank is placed inside the toilet main body 50 described later. The first tank 10 is provided with an inclination portion 13, which rises toward the cutout portion 12 from the recessed portion 11, in front of the cutout portion 12.

Further, the first tank 10 is provided with left and right water storage portions 14L and 14R, which extend upward at the left and right sides of the cutout portion 12. The left and right water storage portions 14L and 14R extend above a peripheral portion 15, which is formed at the front end and the left and right ends of the recessed portion 11 and is raised thereat. The left and right water storage portions 14L and 14R are placed on the left and right sides of the drainage connecting pipe 60 described later when the toilet flush tank is placed inside the toilet main body 50.

The second tank 20 is also formed in a double structure where an insulating material is provided around a water storage portion. Therefore, the second tank 20 is also capable of preventing the generation of condensation that can be caused by the storage of cleaning water.

As shown in FIG. 2, the lower end portion of the second tank 20 communicates with the upper end portion of the left and right water storage portion 14L on the left side (on the near side in FIG. 2) of the first tank 10 via a first connecting pipe 21.

The second tank 20 has an inflow pipe 22 extending upward from the upper end surface thereof. This inflow pipe 22 connects to the downstream end of a water supply channel (not shown). Therefore, cleaning water flows into the second tank 20 via the inflow pipe 22 and further flows into the first tank 10 via the first connecting pipe 21.

A float switch 23 is attached on the upper end surface of the second tank 20. This float switch 23 detects whether or not the second tank 20 is filled up with water. According to this detection signal, an on-off valve provided in a water supply channel (not shown) opens and closes. Thereby, the toilet flush tank is capable of storing cleaning water in an amount that is set by nearly filling the first tank 10 and the second tank 20 with water.

Also, an air intake portion 24 is provided on the upper end surface of the second tank 20.

This air intake portion 24 is capable of letting air flow inside the first tank 10 and the second tank 20 by sucking air from the outside when discharging cleaning water stored in the first tank 10 and the second tank 20 by the pump 30. Therefore, the toilet flush tank is capable of favorably discharging the cleaning water stored in the first tank 10 and the second tank 20.

Further, the second tank 20 has a discharge pipe 25 extending toward the front for overflowed water. The discharge pipe 25 communicates with the water discharge pipe 40 via a connecting pipe 26. When cleaning water stored in the second tank 20 exceeds a reservoir water level that is set, overflowed water is discharged from this discharge pipe 25 and discharged inside a toilet bowl 51 of the toilet main body 50 described later via the connecting pipe 26 and the water discharge pipe 40.

Further, the second tank 20 has an air inlet pipe 27 extending toward the front. This air inlet pipe 27 communicates with an air outlet pipe 16 extending upward at the upper end surface of the left and right water storage portion 14R on the right side (on the far side in FIG. 2) of the first tank 10 via a communication pipe 28 having flexibility. When storing cleaning water in the first tank 10, air gathers in an upper part of the left and right water storage portion 14R on the right side of the first tank 10 as the water level inside the first tank 10 rises. This air can be released into the second tank 20 via the air outlet pipe 16, the communication pipe 28, and the air inlet pipe 27. Therefore, the left and right water storage portion 14R on the right side of the first tank 10 can be also filled up with water without providing an air reservoir in the upper part thereof.

As shown in FIG. 1, the pump 30 is substantially cylindrical and has an inlet port on the lower end surface thereof, and an outlet pipe 31 extends to the outside from the side surface of the pump 30. The inlet port of the pump 30 communicates with the first tank 10 via a second connecting pipe 17 drawn to the upper end surface of the left and right water storage portion 14R on the right side of the first tank 10.

As shown in FIGS. 1 and 2, the water discharge pipe 40 is formed with a first water discharge pipe 41 whose one end is connected to the outlet pipe 31 of the pump 30 and a second water discharge pipe 42 branching to the left and the right, connected to the other end of the first water discharge pipe 41. The second water discharge pipe 42 consists of a branched passage 42A, which is connected to the first water discharge pipe 41 and branches to the left and the right, and left and right water discharge passages 42L and 42R, which extend to the left and right from the branched passage 42A and are bent toward the front (in the lower right direction in FIG. 1) from the left and the right ends thereof. The extremity of the left and right water discharge passage 42R on the right side (on the far side in FIG. 2) is open and forms a first water discharge port 43. Also, the extremity of the left and right water discharge passage 42L on the left side (on the near side in FIG. 2) is closed, and the side surface of an extremity portion is open and forms a second water discharge port 44 (see FIG. 2).

Figure 4:
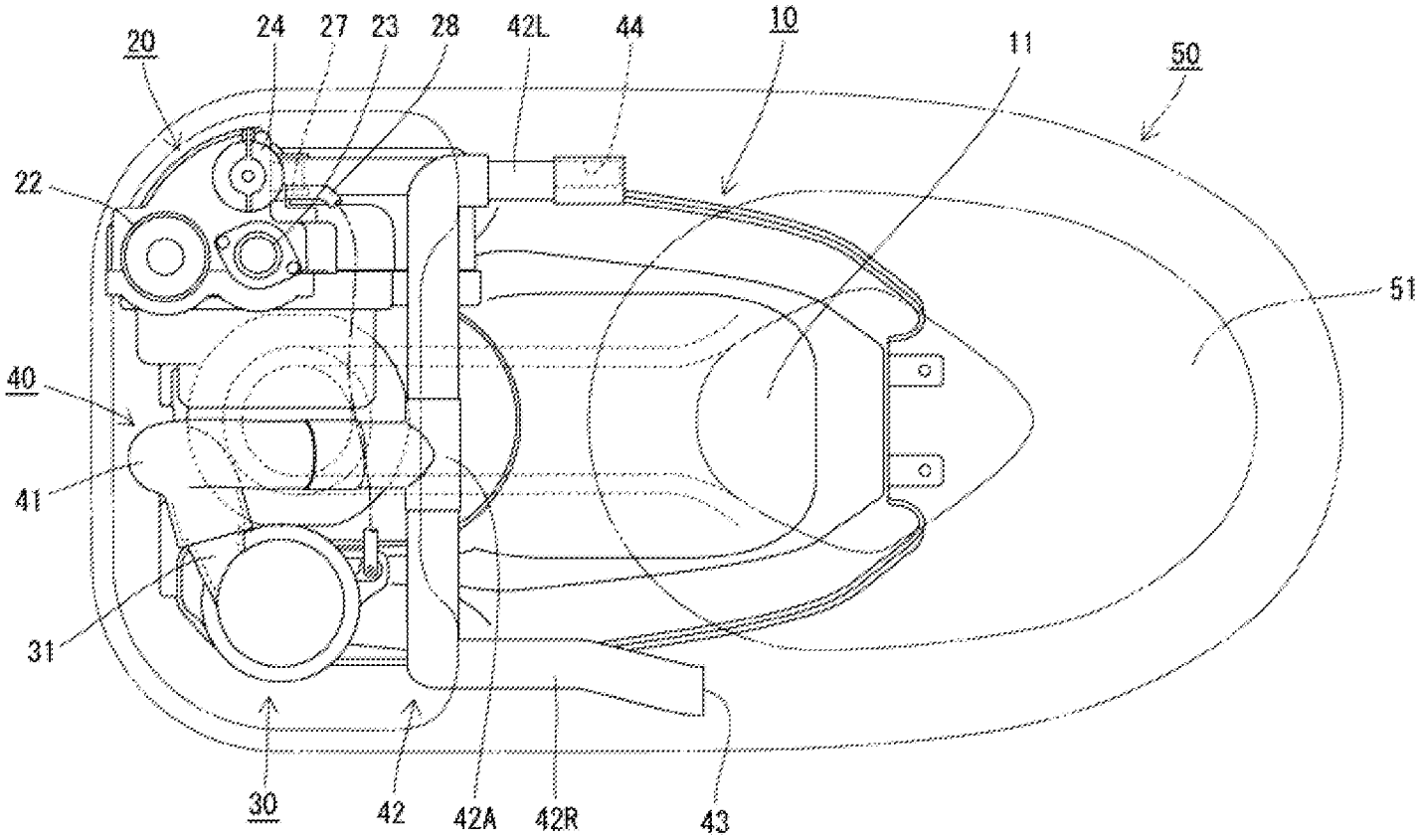
FIG. 4 is a plan transparent view of the flush toilet provided with the toilet flush tank according to the first exemplary embodiment.

A flush toilet provided with a toilet flush tank having such a structure is provided with a toilet main body 50, a drainage connecting pipe 60, and a toilet seat device 70 along with the toilet flush tank, as shown in FIGS. 3 and 4

The toilet main body 50 has a toilet bowl 51 and a toilet drainage channel 52 communicating with the downstream side of the toilet bowl 51. The toilet bowl 51 has a rim water passage 51A formed on an upper end periphery thereof. The toilet bowl 51 has an outlet port 51B located below a water seal surface L and open in the vertical direction. The toilet drainage channel 52 has: a first descending flow passage 52A formed continuously from the outlet port 51B and descending at an angle toward the back; an ascending flow passage 52B formed continuously from the downstream side of the first descending flow passage 52A and ascending at an angle toward the back; and a second descending flow passage 52C formed continuously from the downstream side of the ascending flow passage 52B and descending. A downstream end portion of the second descending flow passage 52C extends downward in the vertical direction. The toilet main body 50 forms a water sealing portion by a portion below the water seal surface L of the toilet bowl 51, the first descending flow passage 52A, and the ascending flow passage 52B. To the toilet main body 50, an insulating material 53 having a shape formed along the first descending flow passage 52A and the ascending flow passage 52B of the toilet drainage channel 52 is attached such that the insulating material 53 covers a lower part of the water sealing portion. Thereby, the generation of condensation on the outer surface of the water sealing portion can be prevented.

The toilet main body 50 has a peripheral wall 54 extending downward from the outer peripheral edge of the upper surface thereof. The peripheral wall 54 extends downward without spreading outside the outer peripheral edge of the upper surface of the toilet main body 50, and the lower end thereof is in contact with a floor surface F. The toilet main body 50 has a reinforcing wall 55 extending to the lower end portion of the peripheral wall 54 from the lower surface of the toilet bowl 51. The toilet main body 50 has a closed space C formed by the reinforcing wall 55, the peripheral wall 54, and a part of the toilet bowl 51. The toilet main body 50 has a storage space S, which is located behind the reinforcing wall 55, surrounded from front to back and from side to side by the reinforcing wall 55 and the peripheral wall 54, and open downward.

The toilet flush tank and the drainage connecting pipe 60 are stored inside the storage space S. In this case, the toilet flush tank is placed such that the recessed portion 11 of the first tank 10 avoids the insulating material 53 that covers the lower part of the water sealing portion. In other words, since the insulating material 53 has a shape formed along the first descending flow passage 52A and the ascending flow passage 52B of the toilet drainage channel 52, the recessed portion 11 of the first tank 10 is formed to conform to the shape of the toilet drainage channel 52. As described, the recessed portion 11, which is provided at the upper surface of the first tank 10, avoiding the insulating material 53 allows the first tank 10 to be placed inside the space below the toilet bowl 51. Therefore, this toilet flush tank is thus capable of storing cleaning water while effectively using a free space inside the space below the toilet bowl 51.

The drainage connecting pipe 60 connects a drainpipe 80 drawn to the floor surface F to the downstream end portion of the second descending flow passage 52C of the toilet drainage channel 52. The left and right water storage portions 14L and 14R are placed on the left and right sides of this drainage connecting pipe 60.

In this manner, by effectively using the free space in the space (storage space S) inside and below the outer peripheral edge of the upper surface of the toilet main body 50, the storage capacity for cleaning water can be increased in the toilet flush tank. Therefore, this toilet flush tank is capable of storing cleaning water in an amount that allows for one-time toilet cleaning.

The first water discharge port 43 formed on the water discharge pipe 40 of the toilet flush tank discharges cleaning water frontward from the right back part of the toilet bowl 51 along the rim water passage 51A, as shown in FIG. 4. The cleaning water discharged from the first water discharge port 43, while flowing along the rim water passage 51A, flows down onto the surface of the toilet bowl 51. Therefore, a swirling flow of the cleaning water swirling inside the toilet bowl 51 is formed in a top view of the toilet main body 50. On the other hand, the second water discharge port 44 formed on the water discharge pipe 40 of the toilet flush tank discharges cleaning water into a water discharge chamber (not shown) that is formed in the left back part of the toilet bowl 51 and that communicates to the toilet bowl 51. The cleaning water discharged from the second water discharge port 44 flows down toward the toilet drainage channel 52 from the left back part and the upper part of the toilet bowl 51 from the water discharge chamber. Therefore, water is discharged from the first water discharge port 43, and a flow is formed that pushes down the cleaning water that has swirled inside the toilet bowl 51 into the toilet drainage channel 52.

In this manner, this flush toilet is capable of discharging cleaning water stored in the toilet flush tank from the first water discharge port 43 and the second water discharge port 44 by the activation of the pump 30 and discharging the cleaning water from the upper part of the toilet bowl 51. Therefore, the flush toilet is capable of allowing all the toilet cleaning water to be used for the cleaning of the toilet bowl 51 and is thus capable of favorably cleaning the toilet bowl 51.

Further, since this flush toilet is capable of performing toilet cleaning using only cleaning water stored in the flush tank, toilet cleaning can be performed using a constant amount of cleaning water every time without being affected by a change in the pressure of tap water.

Therefore, the toilet flush tank according to the first exemplary embodiment is capable of preventing an increase in the external dimensions of the toilet main body 50 even when the toilet flush tank is placed below the upper surface of the toilet main body 50 and is also capable of performing toilet cleaning in a stable manner.

As shown in FIG. 3, the toilet seat device 70 has: a toilet seat device main body 71 placed on the upper surface of the toilet main body 50; and a toilet seat and a toilet lid 72 that are rotatably and pivotably supported at the front of the toilet seat device main body 71. The toilet seat device main body 71 stores a part of the second tank 20 that projects above the toilet main body 50 of the toilet flush tank in such a manner the toilet seat device main body 71 covers the part of the second tank 20 from the above.

<Second Exemplary Embodiment>

Figure 5:
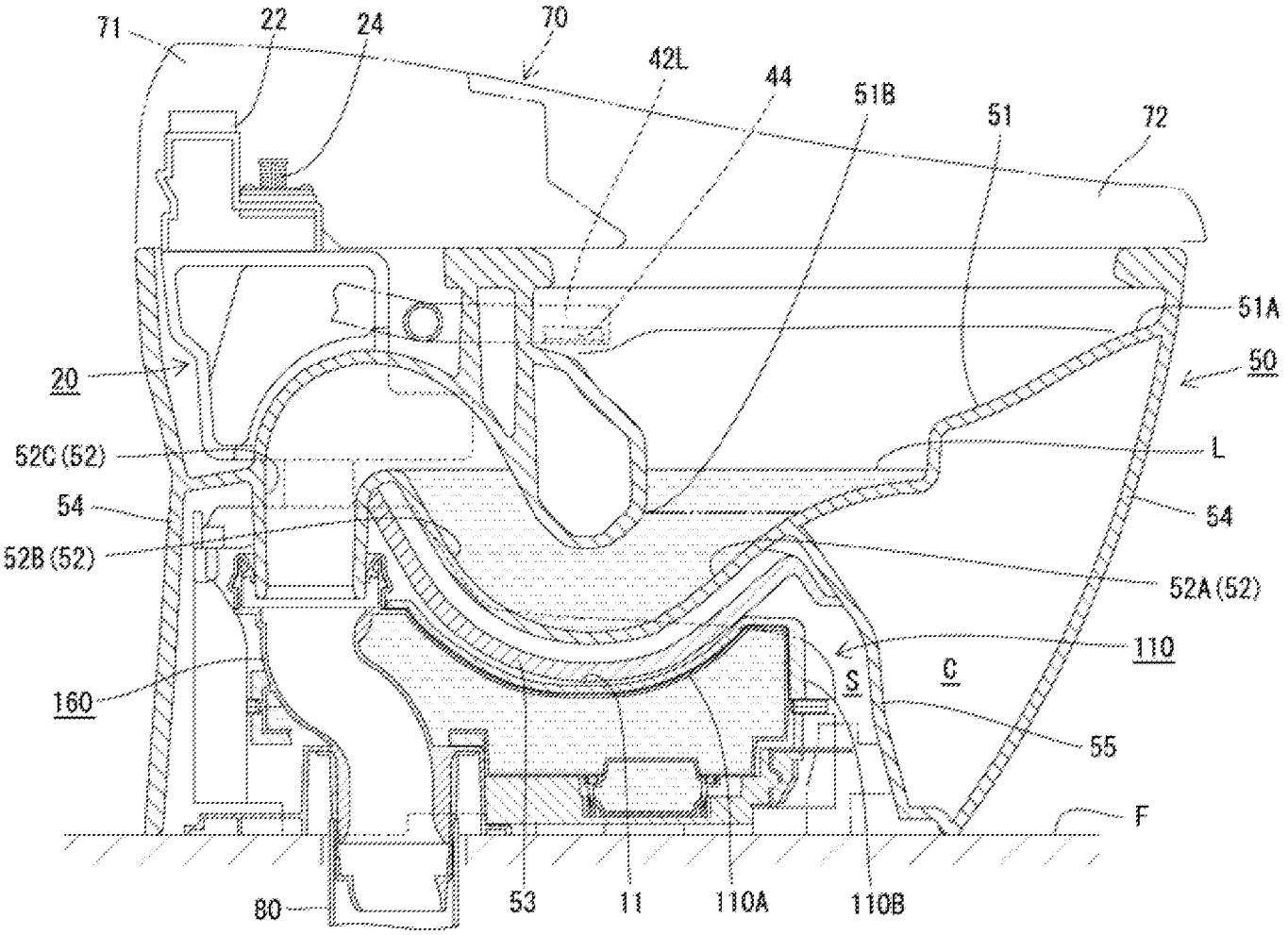
FIG. 5 is a cross-sectional view of a flush toilet provided with the toilet flush tank according to a second exemplary embodiment.

A toilet flush tank according to a second exemplary embodiment is different from that according to the first exemplary embodiment in that a drainage connecting pipe 160 is provided integrally in the toilet flush tank according to the second exemplary embodiment as shown in FIG. 5. The rest of the structures thereof are the same as those of the first exemplary embodiment. The same reference numerals are assigned to the same configurations as in the first exemplary embodiment, and the detailed descriptions thereof are omitted here.

In this toilet flush tank, a tank main body 110A covered by an insulating material 110B of a first tank 110 is provided integrally with a drainage connecting pipe 160. Therefore, a gap between the first tank 110 and the drainage connecting pipe 160 can be eliminated, and the storage capacity of the first tank 110 can thus be increased. Therefore, the toilet flush tank having the first tank 110 is capable of storing cleaning water in an amount that allows for one-time toilet cleaning.

Further, since a flush toilet that is provided with this toilet flush tank is capable of performing toilet cleaning using only cleaning water stored in the flush tank, toilet cleaning can be performed using a constant amount of cleaning water every time without being affected by a change in the pressure of tap water.

Therefore, the toilet flush tank according to the second exemplary embodiment is also capable of preventing an increase in the external dimensions of the toilet main body 50 even when the toilet flush tank is placed below the upper surface of the toilet main body 50 and is also capable of performing toilet cleaning in a stable manner.

The present invention is not limited to the first and second exemplary embodiments explained according to the above descriptions and the figures, and, for example, the following exemplary embodiments are also included in the technical scope of the present invention. (1) In the first and the second exemplary embodiments, a toilet flush tank has a second tank. However, it is not necessary to have a second tank. (2) In the first and the second exemplary embodiments, a first tank of a toilet flush tank has left and right water storage portions. However, it is not necessary to have left and right water storage portions. Alternatively, a water storage portion may be provided only on one side of the left and right sides of the first tank. (3) In the first and the second exemplary embodiments, a pump of an electrically driven type is used. Alternatively, a jet pump that uses a water flow may be used. (4) In the first and the second exemplary embodiments, all the cleaning water stored in a toilet flush tank is discharged from the upper part of a toilet bowl and used for the cleaning of the toilet bowl. Alternatively, a portion of the cleaning water stored in the toilet flush tank may be discharged from a jet port that discharges water toward a toilet drainage channel. (5) In the first and the second exemplary embodiments, a first water discharge port and a second water discharge port are provided, and cleaning water is discharged from two locations on the upper part of a toilet bowl. Alternatively, cleaning water may be discharged from one location on the upper part of the toilet bowl. (6) In the first and the second exemplary embodiments, a recessed portion is formed by a curved surface that conforms to the shape of a toilet drainage channel. Alternatively, the recessed portion may be formed by a flat surface instead of a curved surface. (7) In the first and the second exemplary embodiments, by forming a peripheral portion that is raised at the front end and the left and right ends of a recessed portion, a toilet flush tank (first tank) is formed to conform to the shape of a toilet drainage channel in the longitudinal direction and in the crosswise direction of the toilet flush tank. Alternatively, only the longitudinal direction of the flush tank or the crosswise direction of the flush tank may be formed to conform to the shape of the toilet drainage channel.

DESCRIPTION OF THE REFERENCE NUMERALS

10 first tank
11 recessed portion
14L, 14R left and right water storage portion
20 second tank
30 pump (water lifting device)
50 toilet main body
51 toilet bowl
52 toilet drainage channel (52A first descending flow passage, 52B ascending flow passage, 52C second descending flow passage)
60, 160 drainage connecting pipe
80 drainpipe
S storage space (lower space)
F floor surface

The invention claimed is:

1. A toilet flush tank that stores cleaning water to be provided to a toilet main body having a toilet bowl and a toilet drainage channel communicating with the downstream side of the toilet bowl, wherein the toilet drainage channel has an ascending flow passage; and the toilet flush tank is placed below the ascending flow passage inside a space below the toilet bowl and provided with a recessed portion that conforms to the shape of the ascending flow passage at the upper surface of the toilet flush tank.

2. The toilet flush tank according to claim 1, comprising a water lifting device for discharging the stored cleaning water from an upper part of the toilet bowl.

3. The toilet flush tank according to claim 2 that is provided integrally with a drainage connecting pipe that connects a drainpipe drawn to a floor surface to the toilet drainage channel.

4. The toilet flush tank according to claim 2 that is provided with left and right water storage portions that store cleaning water on the left and right sides of a drainage connecting pipe that connects a drainpipe drawn to a floor surface to the toilet drainage channel.

5. The toilet flush tank according to claim 1 that is provided integrally with a drainage connecting pipe that connects a drainpipe drawn to a floor surface to the toilet drainage channel.

6. The toilet flush tank according to claim 1 that is provided with left and right water storage portions that store cleaning water on the left and right sides of a drainage connecting pipe that connects a drainpipe drawn to a floor surface to the toilet drainage channel.

* * * * *